US008429857B2

(12) United States Patent
Melrose et al.

(10) Patent No.: US 8,429,857 B2
(45) Date of Patent: Apr. 30, 2013

(54) BLAST AND BALLISTIC PROTECTION SYSTEM

(75) Inventors: Paul T. Melrose, Orono, ME (US); Richard F. Nye, Old Town, ME (US); Ashley E. Tower, Bangor, ME (US); Laurent R. Parent, Veazie, ME (US); Robert T. O'Neil, Orono, ME (US)

(73) Assignee: University of Maine System Board of Trustees, Bangor, ME (US)

( * ) Notice: Subject to any disclaimer, the term of this patent is extended or adjusted under 35 U.S.C. 154(b) by 142 days.

(21) Appl. No.: 13/059,748

(22) PCT Filed: Aug. 18, 2009

(86) PCT No.: PCT/US2009/054153

§ 371 (c)(1),
(2), (4) Date: Apr. 11, 2011

(87) PCT Pub. No.: WO2010/022044

PCT Pub. Date: Feb. 25, 2010

(65) Prior Publication Data

US 2011/0197746 A1 Aug. 18, 2011

Related U.S. Application Data

(60) Provisional application No. 61/089,722, filed on Aug. 18, 2008.

(51) Int. Cl.
*E04H 9/04* (2006.01)

(52) U.S. Cl.
USPC ..... 52/79.1; 52/63; 52/79.12; 52/169.6

(58) Field of Classification Search ..... 52/63, 79.1, 52/79.12, 167.1, 169.6, 222, 273
See application file for complete search history.

(56) References Cited

U.S. PATENT DOCUMENTS 2,751,635 A * 6/1956 Donnahue ..... 52/69
4,325,309 A 4/1982 King et al.

(Continued)

FOREIGN PATENT DOCUMENTS

JP 2007-327232 A 12/2007

OTHER PUBLICATIONS

U.S. Appl. No. 12/244,407, filed Oct. 2, 2008; Habib J. Dagher et al.

(Continued)

*Primary Examiner* — Jeanette E Chapman
*Assistant Examiner* — James Buckle, Jr.
(74) *Attorney, Agent, or Firm* — MacMillan, Sobanski & Todd, LLC

(57) ABSTRACT

A blast and ballistic protective wall assembly for use on an exterior of a container includes a frame having four corner posts, two lower side members having fork lift openings formed therethrough, two upper side members, two lower cross members, two upper cross members, lower corner castings attached to the lower ends of the corner posts, and upper corner castings attached to the upper ends of the corner posts, the frame supporting side walls, end walls, and a roof of the container. The blast and ballistic protective wall assembly further includes an attachment member attached to a portion of the frame and a plurality of composite panels. One end of each panel is attached to the attachment member, and the other end of the panel is attached to another panel, a portion of the frame, or another attachment member. Each panel is thereby attached to a wall of the container.

16 Claims, 12 Drawing Sheets

U.S. PATENT DOCUMENTS

| | | | | |
|---|---|---|---|---|
| 4,389,947 | A | 6/1983 | King et al. | |
| 4,822,657 | A | 4/1989 | Simpson | |
| 4,830,245 | A | 5/1989 | Arakaki | |
| 5,470,631 | A | 11/1995 | Lindquist et al. | |
| 5,720,403 | A | 2/1998 | Sawyer | |
| 5,761,854 | A * | 6/1998 | Johnson et al. | 52/69 |
| 6,220,265 | B1 * | 4/2001 | Zheng | 135/125 |
| 7,418,802 | B2 * | 9/2008 | Sarine et al. | 52/79.5 |
| 7,685,921 | B2 | 3/2010 | Dagher et al. | |
| 7,827,738 | B2 * | 11/2010 | Abrams et al. | 52/79.1 |
| 7,966,775 | B2 * | 6/2011 | Medley | 52/79.5 |
| 8,001,730 | B2 * | 8/2011 | Wallance | 52/79.1 |
| 2002/0007602 | A1 * | 1/2002 | Corcoran | 52/122.1 |
| 2007/0107321 | A1 * | 5/2007 | Sarine et al. | 52/71 |
| 2007/0180982 | A1 | 8/2007 | Dagher et al. | |

OTHER PUBLICATIONS

PCT International Search Report and the Written Opinion of the International Searching Authority dated Mar. 25, 2010, International Application No. PCT/US2009/054153 filed Aug. 18, 2009.

* cited by examiner

BLAST AND BALLISTIC PROTECTION SYSTEM

CROSS REFERENCE TO RELATED APPLICATIONS

This application claims the benefit of U.S. Provisional Application No. 61/089,722 filed Aug. 18, 2008.

This invention was made with U.S. government support under U.S. Army Natick Soldier Research Development & Engineering Center Contract No. W911QY-05-C-0043, and U.S. Army Engineer Research and Development Center Contract No. W81EWF-5224-6597. The United States government has certain rights in this invention.

Inventors: Paul T. Melrose, Richard F. Nye, Ashley E. Tower, Laurent R. Parent, and Robert T. O'Neil.

BACKGROUND

Various embodiments of a blast and ballistic protection system are described herein. In particular, the embodiments described herein relate to a system for blast and ballistic protection for use on an exterior of an ISO container.

Protective armor typically is designed for several applications types: personal protection such as helmets and vests, vehicle protection such as for high mobility multi-wheeled vehicles (HMMWVs), and rigid structures such as buildings. The protection of troops, for example, housed in containerized housing units requires both blast and ballistic protection. Blast protection typically requires the material to have the structural integrity to withstand the high loads of blast pressure. Ballistic protection typically requires the material to stop the progress of bomb fragments ranging in size from less than one millimeter to 10 mm or more and traveling at velocities in excess of 2000 meters per second for smaller fragments.

International Organization for Standardization (ISO) containers are commonly used to house soldiers, disaster relief workers, contractors, and others where temporary and rapidly deployable shelters are used. Additionally, containers are used for mobile medical units, command and control centers, communications, equipment storage, and the like. Many of these applications are located in areas exposed to threats such as car bombs, mortars, improvised explosive devices (IEDs), small arms fire, etc. Containers converted for these applications typically do not have systems for blast and fragmentation mitigation.

U.S. patent application Ser. No. 12/244,407 to Dagher et al. discloses various embodiments of a blast mitigation and ballistic protection system and various embodiments of a protective composite panel 10, 10'. U.S. patent application Ser. No. 12/244,407 further discloses a blast mitigation and ballistic protection system 300 structured and configured to be mounted within the interior of the ISO container 302 for the protection of personnel and equipment. The system 300 includes a wall panel assembly 240, the composite panel 10, and a roof panel assembly 241. U.S. patent application Ser. No. 12/244,407 to Dagher et al. is incorporated herein by reference.

U.S. patent application Ser. No. 11/699,872 to Dagher et al. discloses a tent ballistic protection system 100. The system 100 includes a plurality of composite panels 10, 10', 10', or 30 having a size and shape suitable for mounting to the interior vertical walls of a tent 114 having a frame 116.

FIG. 1 illustrates a known load-carrying element or frame 10 for box container as defined in ISO 1161. The frame 10 typically supports side walls, end walls (including at least one door 11), a floor, and a roof of the container, and is typically formed from steel. The frame 10 includes four corner posts 12, two lower side members 14, two upper side members 16, two lower cross members 18, two upper cross members typically configured as a front upper end member 20, and a door header 22. Fork lift openings 19 are formed in the lower cross members 18. Lower corner fittings or castings 24 are attached to the lower ends of the corner posts 12 and upper corner castings 25 are attached to the upper ends of the corner posts 12.

The shapes of the corner castings 24 and 25 are also defined in ISO 1161. The lower corner castings 24 include a substantially oval shaped opening 26 formed in the outwardly facing sides 28 of the castings 24.

SUMMARY

The present application describes various embodiments of a blast and ballistic protection system. In one embodiment, a blast and ballistic protective wall assembly for use on an exterior of a container includes a frame having four corner posts, two lower side members having fork lift openings formed therethrough, two upper side members, two lower cross members, two upper cross members, lower corner castings attached to the lower ends of the corner posts, and upper corner castings attached to the upper ends of the corner posts, the frame supporting side walls, end walls, and a roof of the container. The blast and ballistic protective wall assembly further includes an attachment member attached to a portion of the frame and a plurality of composite panels. One end of each panel is attached to the attachment member, and the other end of the panel is attached to another panel, a portion of the frame, or another attachment member. Each panel is thereby attached to a wall of the container.

Other advantages of the blast and ballistic protection system will become apparent to those skilled in the art from the following detailed description, when read in light of the accompanying drawings.

DETAILED DESCRIPTION

Members of the military or other persons located in combat or hostile fire areas may work or sleep in temporary or semi-permanent structures that require protection from blast and/or from ballistic projectiles. Examples of such structures include tents, South East Asia huts (SEAHUTS), containerized housing units (CHU), and modified ISO containers. It will be understood that other types of temporary, semi-permanent, or permanent structures may require protection from blast and/or from ballistic projectiles.

Like personal protective armor, but unlike protective armor provided for vehicles and permanent structures, the weight of such protection is an important consideration for two reasons. First, the material in panel form should be light enough to be moved and installed by persons, such as members of the military, without lifting equipment. Second, the panels should be light enough so as not to overstress the container frame either statically or dynamically. Desirably, blast and ballistic protection for temporary or semi-permanent structures will have a low unit area cost because the surface area to be covered of such temporary or semi-permanent structures is large. Additionally, the ballistic protection must have sufficient structural integrity to withstand blast forces over a relative long span, because many such temporary or semi-permanent structures have widely spaced support or framing members.

As used in the description of the invention and the appended claims, the phrase "attachment member" is defined as any one of the various components of the blast and ballistic protection system 30 used to attach any other of the various components of the blast and ballistic protection system 30 to the ISO container frame 10, or to another of the various components the blast and ballistic protection system 30.

Figure 1A:
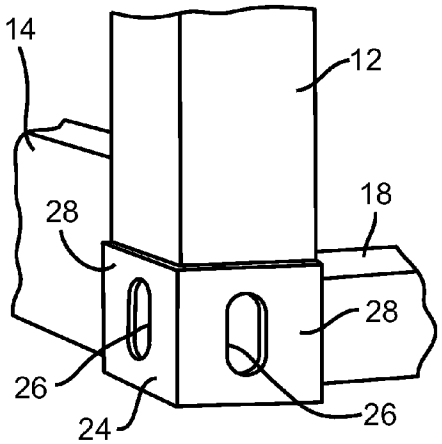
FIG. 1A (Prior Art)
FIG. 1 is a perspective view of a known frame for an ISO container.
Figure 1:
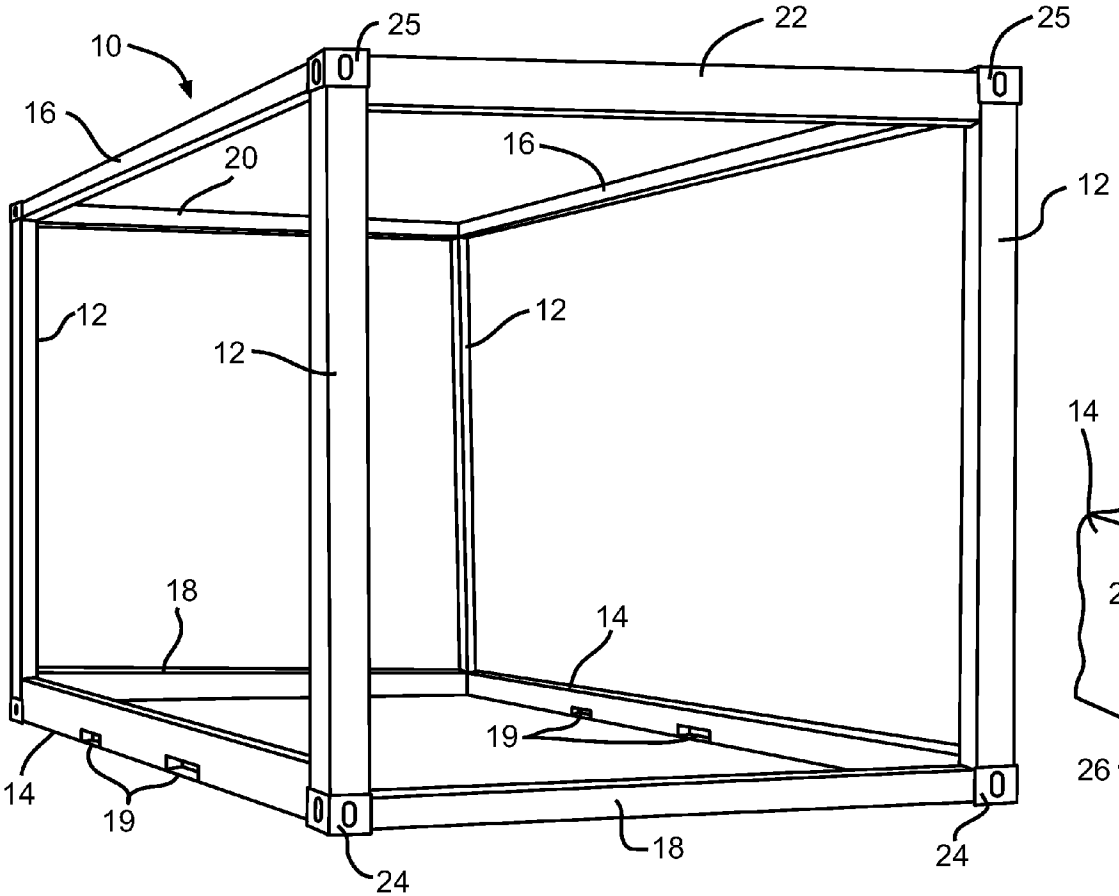
FIG. 1 (Prior Art)
Figure 2:
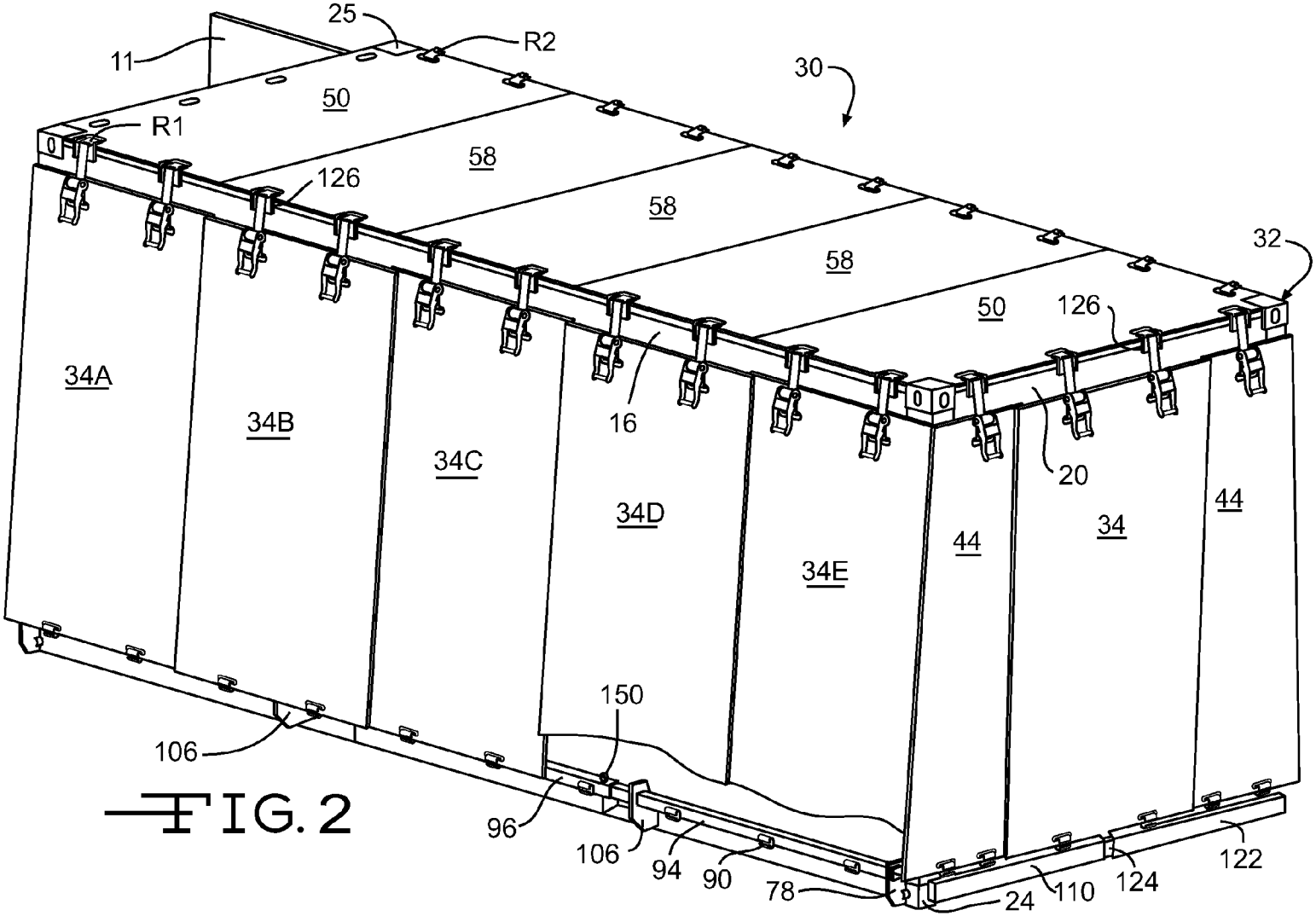
FIG. 2 is a perspective view of an ISO container to which a blast and ballistic protection system is installed.

Referring now to FIG. 2, there is illustrated generally at 30 a perspective view of a first embodiment of a blast and ballistic protection assembly or system. In the illustrated embodiment, the various components of the blast and ballistic protection system 30, each of which is described in detail below, are installed on an exterior of a conventional ISO container 32 having a frame 10, as shown in FIG. 1.

It will be understood that prior to installing any portion of the blast and ballistic protection system 30 to deployed ISO container, any obstructions will be removed from the fork lift openings 19, and the lower and upper corner castings 24 and 25, respectively. All items will be removed from the roof of the container 32 and all electrical and HVAC connectors will be disconnected from the container and set aside.

Figures 3, 4, 5, 6:
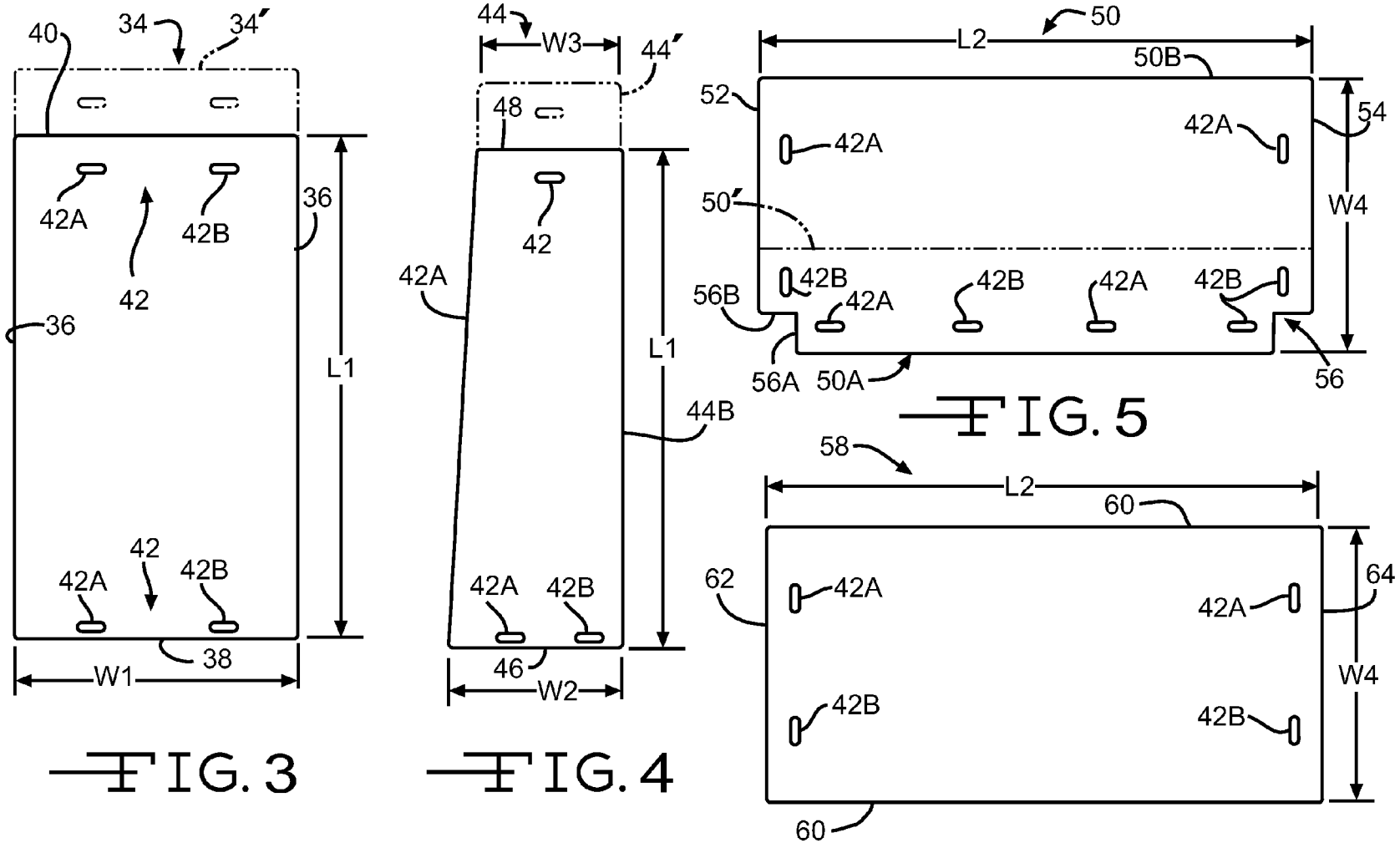
FIG. 3 is a plan view of the side wall panel illustrated in FIG. 2.
FIG. 4 is a plan view of the end wall panel illustrated in FIG. 2.
FIG. 5 is a plan view of the roof end panel illustrated in FIG. 2.
FIG. 6 is a plan view of the roof center panel illustrated in FIG. 2.

Referring now to FIG. 3, there is illustrated generally at 34 a plan view of a first embodiment of a first or side wall composite panel. The composite panel 34 and the composite panels described and illustrated below may be any desired composite panel with suitable blast and ballistic protection properties, such as the panels described in U.S. patent application Ser. No. 12/244,407 to Dagher et al. In the illustrated embodiment, the side wall panel 34 is substantially rectangular having sides 36, a first or lower end 38, and a second or upper end 40. The illustrated side wall panel 34 has a length L1 and a width W1 chosen to fit on a side wall of an ISO container 32. The illustrated side wall panel 34 has a length L1 of about 86.75 inches. Alternatively, the length L1 may be within the range of from about 60.0 inches to about 108.0 inches. The illustrated side wall panel 34 has a width W1 of about 49.0 inches. Alternatively, the length W1 may be within the range of from about 24.0 inches to about 72.0 inches.

The panel 34 may include a plurality of handholds or attachment slots 42. In the embodiment illustrated in FIG. 3, the slots 42 are formed as pairs of slots 42A and 42B. The illustrated slots 42A and 42B are formed adjacent a peripheral edge of the lower end 38 and the upper end 40. The slots 42A and 42B formed at the lower end 38 are spaced about 1.38 inches from an edge of the lower end 38. Alternatively, the slots 42A and 42B may be spaced any desired distance from the edge of the lower end 38 of the panel 34, such as within the range of from about 0.50 inches to about 6.0 inches from the edge of the panel 34. The slots 42A and 42B formed at the upper end 40 are spaced about 4.50 inches from an edge of upper end 40. Alternatively, the slots 42A and 42B may be spaced any desired distance from the edge of the edge of the upper end 40 of the panel 34, such as within the range of from about 0.50 inches to about 24.0 inches from the edge of the panel 34. It will be understood that any desired number of slots 42 may be provided, such as for example one slot, three slots, or more than three slots. The slots 42A and 42B may be of any desired length and width. In the illustrated embodiment, the slots 42A and 42B have a length long enough to receive a plurality of strap 152, 156 sizes, as will be described in detail herein.

Referring now to FIG. 4, there is illustrated generally at 44 a plan view of a first embodiment of a second or end wall composite panel. In the illustrated embodiment, the end wall panel 44 is substantially trapezoidal having sides 44A and 44B, a first or lower end 46, and a second or upper end 48. The illustrated end wall panel 44 has a length L1 and widths W2 and W3 chosen to fit on an end wall of an ISO container 32. The side 44A is angled outwardly from the upper end 48 to the lower end 46 such that the upper end 48 is shorter than the lower end 46. The lower end 46 of the illustrated end wall panel 44 has a width W2 of about 30.0 inches. Alternatively, the width W2 may be within the range of from about 15.0 inches to about 55.0 inches. The upper end 48 of the illustrated end wall panel 44 has a width W3 of about 25.0 inches. Alternatively, the width W3 may be within the range of from about 10.0 inches to about 50.0 inches.

The panel 44 may include a plurality of the attachment slots 42. In the embodiment illustrated in FIG. 4, the slots 42 at the lower end 46 are formed as a pair of slots 42A and 42B. One slot 42 may be formed at the upper end 48. The illustrated slots 42A, 42B, and 42 are formed adjacent a peripheral edge of the lower end 46 the upper end 48. The slots 42A and 42B formed at the lower end 46 are spaced about 1.38 inches from an edge of the lower end 46. Alternatively, the slots 42A and 42B may be spaced any desired distance from the edge of the lower end 46 of the panel 44, such as within the range of from about 0.50 inches to about 6.0 inches from the edge of the panel 44. The slot 42 formed at the upper end 48 is spaced about 4.50 inches from an edge of the upper end 48. Alternatively, the slot 42 may be spaced any desired distance from the edge of the edge of the upper end 48 the panel 44, such as within the range of from about 0.50 inches to about 24.0 inches from the edge of the panel 44.

Referring now to FIG. 5, there is illustrated generally at 50 a plan view of a first embodiment of a roof end composite panel. In the illustrated embodiment, the roof end panel 50 is substantially rectangular having sides 50A and 50B, a first end 52, and a second end 54. The illustrated roof end panel 50 has a length L2 and width W4 chosen to fit on a roof of an ISO container 32. The illustrated roof end panel 50 has a length L2 of about 96.00 inches. Alternatively, the length L2 may be within the range of from about 48.0 inches to about 100.0 inches. The illustrated roof end panel 50 has a width W4 of about 47.69 inches. Alternatively, the width W4 may be within the range of from about 24.0 inches to about 72.0 inches.

In the illustrated embodiment, notches 56 are formed at the corners of the first end 52 and the side 50A and the second end 54 and the side 50A. As will be explained below in detail, the notches 56 provide clearance for the panel 50 to fit about upper corner castings 25 of the ISO container frame 10. In the illustrated embodiment, the notches 56 have a first edge 56A having a first length of about 7.25 inches and a second edge 56B having a second length of about 6.60 inches. The notches 56 may have any dimension required to fit about the upper corner castings 25 of the ISO container frame 10.

The panel 50 may include a plurality of the attachment slots 42. In the embodiment illustrated in FIG. 5, the slots 42 at the first and second ends 52 and 54 are formed as pairs of slots 42A and 42B. Two pair of the slots 42A and 42B are formed at the side 50A. The illustrated slots 42A, 42B are spaced about 4.0 inches from an edge of the composite panel 50. Alternatively, the slots 42A and 42B may be spaced any desired distance from the edges of the panel 50, such as within the range of from about 0.50 inches to about 24.0 inches from the edge of the panel 50.

Referring now to FIG. 6, there is illustrated generally at 58 a plan view of a first embodiment of a roof center composite panel. The roof center panel 58 is substantially similar to the roof center panel 58 but has the length L2 and the width W4. In the illustrated embodiment, the roof center panel 58 is substantially rectangular having sides 60, a first end 62, and a second end 64. The panel 58 may include a plurality of the attachment slots 42. In the embodiment illustrated in FIG. 6, the slots 42 at the first and second ends 62 and 64 are formed as pairs of slots 42A and 42B. The illustrated slots 42A and 42B are spaced about 4.0 inches from an edge of the roof center panel 58. Alternatively, the slots 42A and 42B may be spaced any desired distance from the edges of the panel 58, such as within the range of from about 0.50 inches to about 24.0 inches from the edge of the panel 58.

Figures 7A, 7B, 7C:
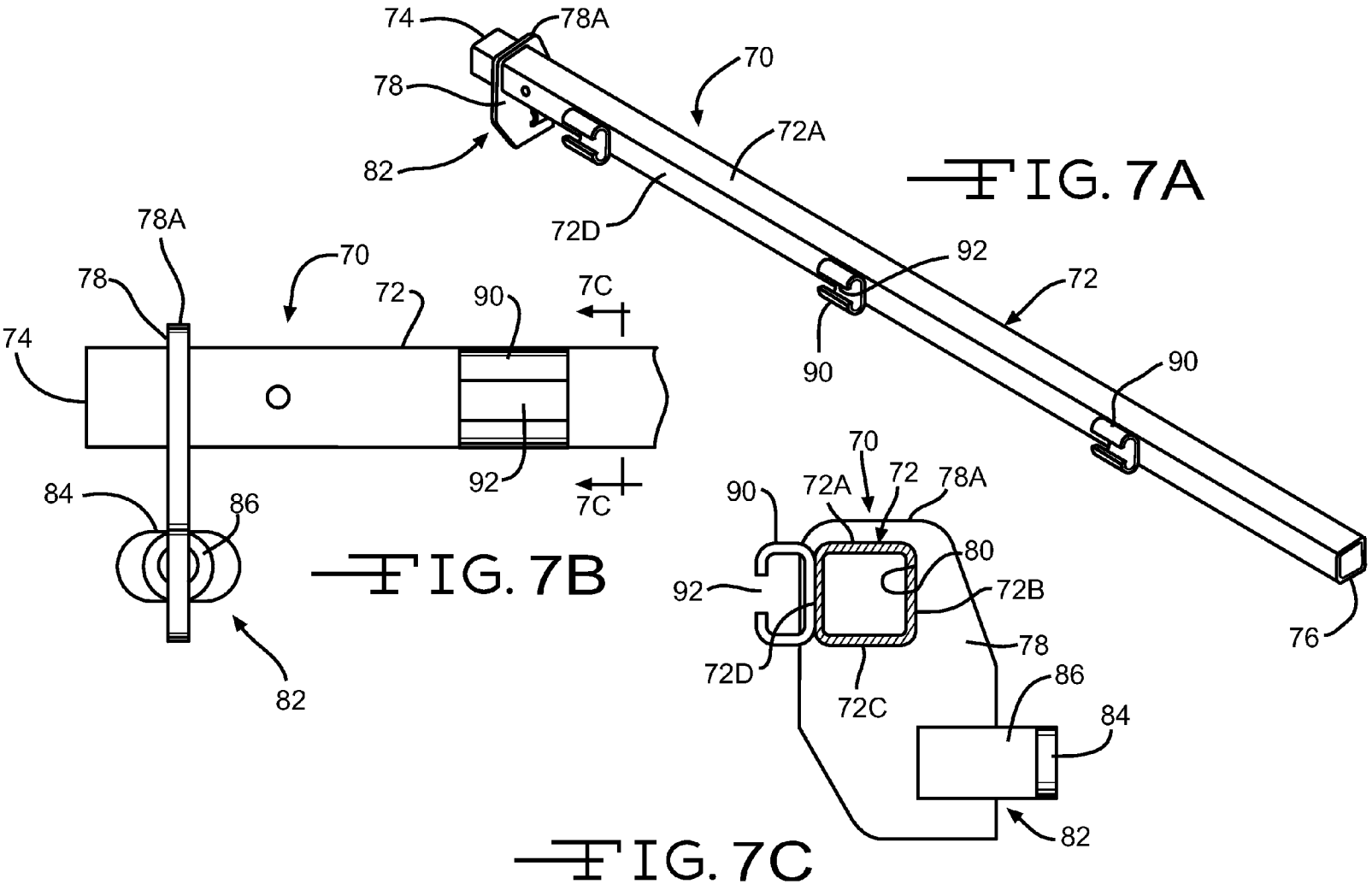
FIG. 7A is a perspective view of the left side wall rail illustrated in FIG. 2.
FIG. 7B is an enlarged elevational view of a portion of the left side wall rail illustrated in FIG. 7A.
FIG. 7C is an end view, partially in section taken along the line 7C-7C of FIG. 7B.

Referring now to FIGS. 7A through 7C, there is illustrated generally at 70 a left side wall rail. The left side wall rail 70 includes a substantially hollow tube 72 having a substantially square transverse section. The tube 72 has a first end 74 and a second end 76 and includes sides 72A, 72B, 72C, and 72D, each having an outside width of about 2.5 inches. Alternatively, the sides 72A-72D may have any desired width, such as within the range of from about 1.50 inches to about 6.0 inches. The illustrated tube 72 has a length of about 78.0 inches. Alternatively, the tube 72 may have any desired length, such as within the range of from about 48.0 inches to about 96.0 inches. It will be understood that the tube 72 may be structured and configured other than as illustrated. For example, the illustrated tube 72 has a substantially square transverse sectional shape. Alternatively, the tube 72 may have any other desired transverse sectional shape, such as for example rectangular, other polygonal shapes, and substantially cylindrical.

A rail mounting aperture 80 is formed in a substantially flat bracket 78. A locking assembly 82 extends outwardly of the bracket 78 and substantially perpendicularly to the longitudinal side 72B of the tube 72. In the illustrated embodiment, the locking assembly 82 includes a substantially flat and oval shaped locking member 84 mounted transversely to a plane of the flat bracket 78. The locking member 84 may be attached to the flat bracket 78 by an attachment member, such as the substantially cylindrical member 86.

A plurality of panel clips or brackets 90 are attached to the tube 72 and extend outwardly of the side 72D of the tube 72. The brackets 90 have a substantially C-shaped transverse section defining an opening 92. The brackets 90 are positioned on the tube 72 such that the openings 92 are positioned and oriented at about 180 degrees from the locking assembly 82. In the illustrated embodiment, three brackets 90 are attached to the tube 72. Alternatively, any desired number of brackets 90 may be attached to the tube 72. Alternatively, any other desired structure and configuration of the bracket 90 may be provided. Additionally, the rails, such at the rails 70 and 94 may include openings (not shown) for interconnecting to corresponding clips or brackets, such as the brackets 90, attached to the panels.

The tube 72 is attached within the aperture 80 in the flat bracket 78 such that a first or upper side 78A of the flat bracket 78 is adjacent the side 72A of the tube 72, and the flat bracket 78 is about 2.13 inches from the first end 74 of the tube 72. Alternatively, the flat bracket 78 may be attached at any desired distance from the first end 74 of the tube 72, so as to ensure the locking assembly 82 corresponds with the opening 26 in the corner casting 24.

The flat bracket 78, tube 72, locking member 84, and attachment member 86 may be attached to one another by any desired method, such as welding. Alternatively, the flat bracket 78, tube 72, locking member 84, and attachment member 86 may be attached to one another through the use of mechanical fasteners, adhesives, and other attachment means.

Figures 8, 9A, 9B:
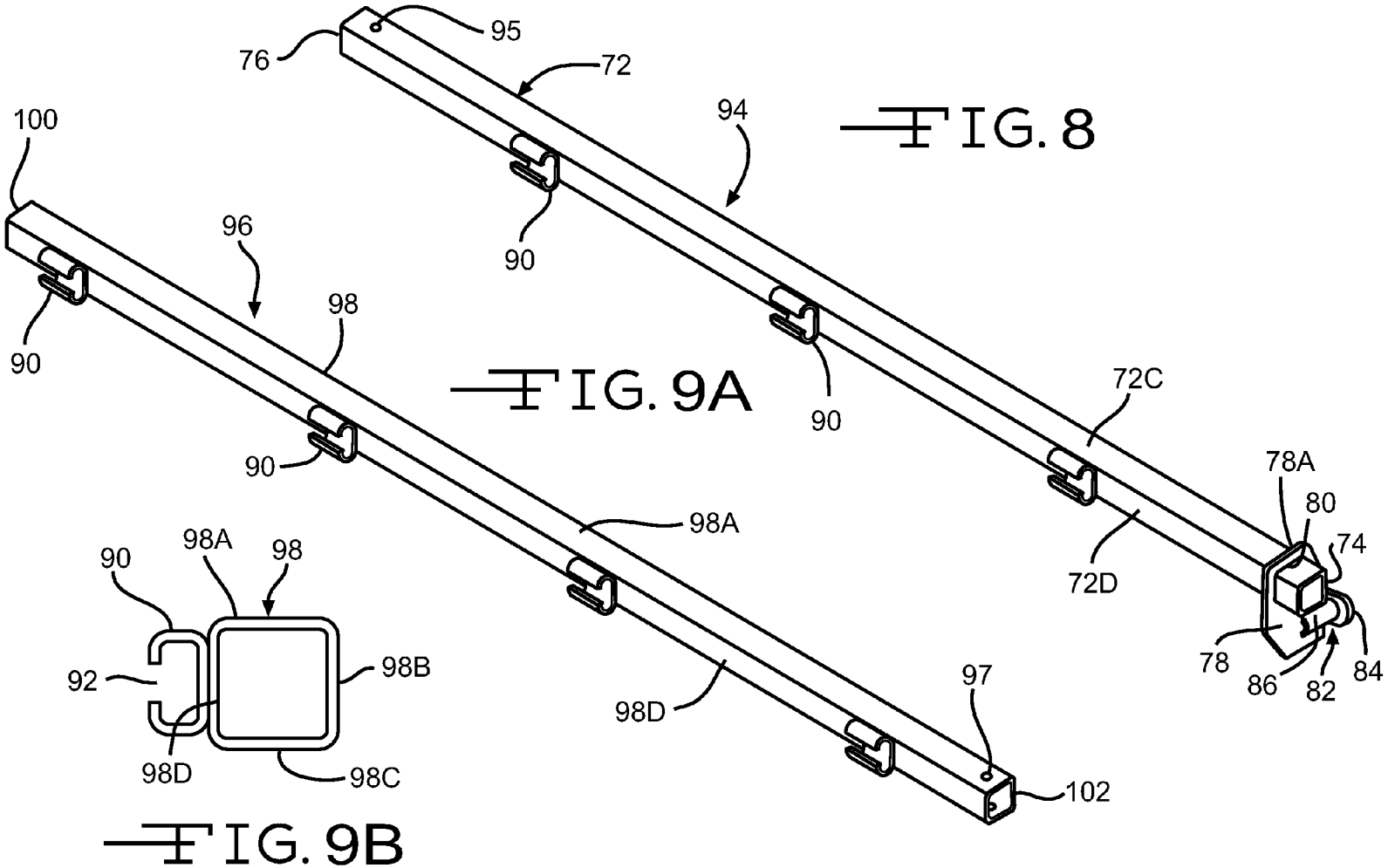
FIG. 8 is a perspective view of the right side wall rail illustrated in FIG. 2.
FIG. 9A is a perspective view of the center side wall rail illustrated in FIG. 2.
FIG. 9B is an end view of the center side wall rail illustrated in FIG. 9A.

Referring now to FIG. 8, there is illustrated generally at 94 a right side wall rail. The right side rail 94 is identical to the left side rail 74 except that the tube 72 is attached within the aperture 80 in the flat bracket 78 such that the upper side 78A of the flat bracket 78 is adjacent the side 72C of the tube 72.

Referring now to FIG. 9, there is illustrated generally at 96 a center side wall rail for interconnecting the right and left side rails 70 and 94. The center side wall rail 96 includes a substantially hollow tube 98 having a substantially square transverse section. The tube 98 has a first end 100 and a second end 102 and includes sides 98A, 98B, 98C, and 98D, each having an inside width W5 larger than the outside widths of the sides 72A-72D of the tubes 72 of the left and right side rails 70 and 94, such that the tube 98 may be installed over the tubes 72 in a telescoping arrangement. Alternatively, the tube 98 may have any desired transverse sectional shape corresponding to the sectional shape of the tube 72, such as rectangular or cylindrical.

In the illustrated embodiment the sides 98A-98D have an outside width of about 3.0 inches. Alternatively, sides 98A-98D may have any desired length, such as within the range of from about 1.0 inches to about 7.0 inches. The illustrated tube 98 has a length of about 86.0 inches. Alternatively, the tube 98 may have any desired length, such as within the range of from about 24.0 inches to about 240.0 inches.

A plurality of the panel brackets 90 are attached to the tube 98 and extend outwardly of the side 98D. In the illustrated embodiment, four brackets 90 are attached to the tube 98. Alternatively, any desired number of brackets 90 may be attached to the tube 98.

Figure 10:
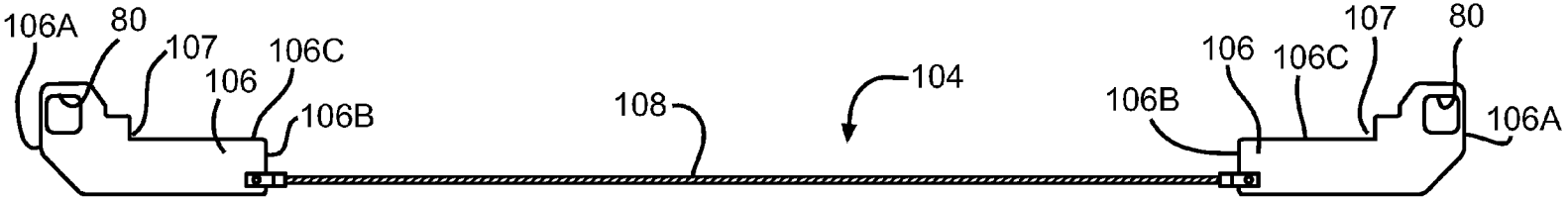
FIG. 10 is a side elevational view of the connector assembly illustrated in FIG. 2.

Referring now to FIG. 10, there is illustrated generally at 104 a connector assembly. The illustrated connector assembly 104 includes a pair of substantially flat connector brackets 106. The connector bracket 106 has a first or outboard end 106A and a second or inboard side 106B. The mounting aperture 80 is formed through the bracket 106 adjacent the outboard end 106A. A notch 107 is formed in an edge 106C (upwardly facing edge when viewing FIG. 10). A substantially flexible connecting member 108 is connected between the inboard ends 106B of each of the pair of brackets 106. In the illustrated embodiment, the connecting member 108 is a 7×19×⅜ inch wire rope. Alternatively, the connecting member 108 may be formed from any other desired material, such as cable or rope. In the illustrated embodiment the wire rope 108 has a length of about 74.75 inches. Alternatively, the wire rope 108 may have any desired length, such as within the range of from about 24.0 inches to about 96.0 inches.

Figure 11C:
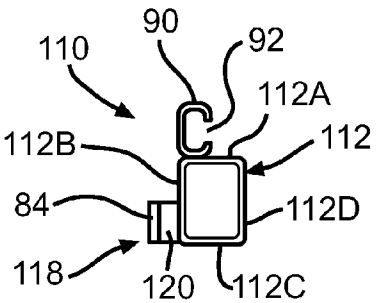
FIG. 11C is an end view taken along the line 11C-11C of FIG. 11B.
Figure 11A:
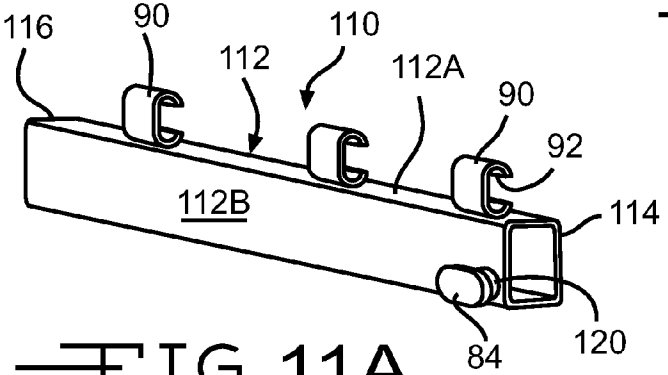
FIG. 11A is a perspective view of the left end wall rail illustrated in FIG. 2.
Figure 11B:
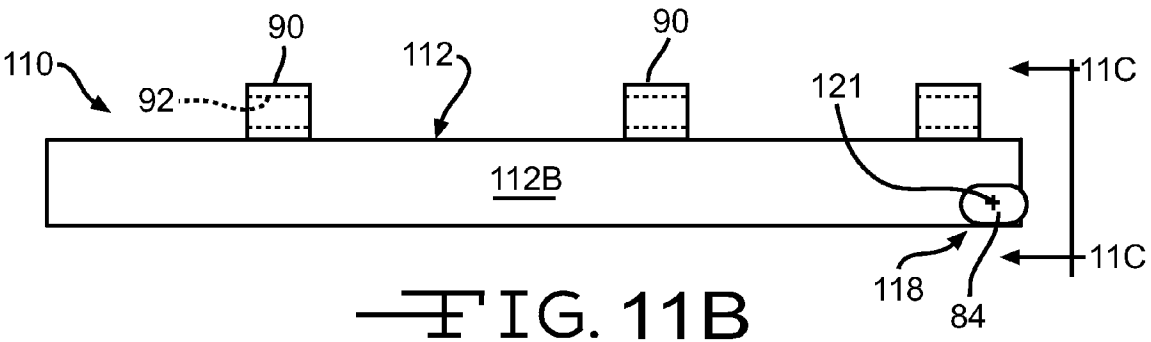
FIG. 11B is an enlarged elevational view of the left end wall rail illustrated in FIG. 11A.

Referring now to FIG. 11, there is illustrated generally at 110 a left end wall rail. The left end wall rail 110 includes a substantially hollow tube 112 having a substantially rectangular transverse section. The tube 112 has a first end 114 and a second end 116 and includes sides 112A, 112B, 112C, and 112D. The sides 112A and 112C have an outside width of about 3.0 inches. The sides 112B and 112D have an outside width of about 4.0 inches. Alternatively, the sides 112A and 112C may have any desired width, such as within the range of from about 1.0 inches to about 7.0 inches, and the sides 112B and 112D may have any desired width, such as within the range of from about 1.5 inches to about 8.0 inches. The illustrated tube 112 has a length of about 45.0 inches. Alternatively, the tube 112 may have any desired length, such as within the range of from about 12.0 inches to about 96.0 inches. Alternatively, the tube 112 may have any desired transverse sectional shape, such as square or cylindrical.

A locking assembly 118 extends outwardly and substantially perpendicularly to the longitudinal side 112B of the tube 112. In the illustrated embodiment, the locking assembly 118 includes the substantially flat and oval shaped locking member 84. The locking member 84 may be attached to the tube 112 by an attachment member, such as the substantially cylindrical member 120.

A plurality of the panel brackets 90 are attached to the side 112A of the tube 112. The brackets 90 are positioned on the tube 112 such that the openings 92 are positioned and oriented at about 180 degrees from the locking assembly 118. In the illustrated embodiment, three brackets 90 are attached to the tube 112. Alternatively, any desired number of brackets 90 may be attached to the tube 112. A first end 90A of a first of the brackets 90 is positioned about 1.92 inches from the first end 114. The first ends 90A of a second and a third bracket 90 are positioned about 15.42 inches and 32.92 inches, respectively, from the first end 114. Alternatively, the brackets 90 may be positioned at any desired distance from the first end 114.

The locking assembly 118 is attached to the tube 112 such that the center 121 of the member 120 is positioned about 1.25 inches from the first end 114 of the tube 112. Alternatively, the locking assembly 118 may be attached at any desired distance from the first end 114 of the tube 112, such as within the range of from about 0.90 inches to about 6.0 inches from the first end 114 of the tube 112.

Figure 12B:
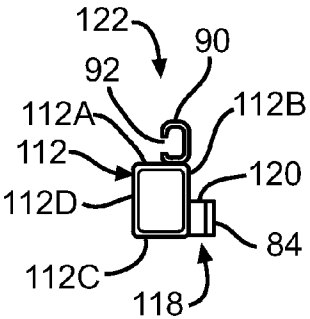
FIG. 12B is an end view taken along the line 12B-12B of FIG. 12A.
Figure 12A:
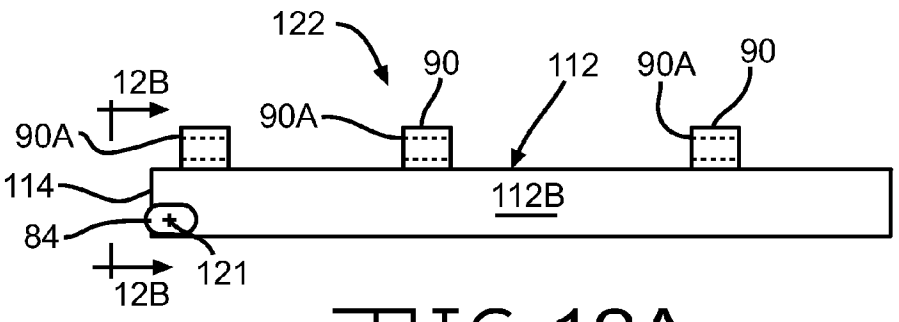
FIG. 12A is a side elevational view of the right end wall rail illustrated in FIG. 2.

Referring now to FIG. 12, there is illustrated generally at 122 a right end wall rail. The right end wall rail 122 includes the substantially hollow tube 112. The locking assembly 118 extends outwardly and substantially perpendicularly to the longitudinal side 112B of the tube 112. A plurality of the panel brackets 90 are attached to the side 112A of the tube 112. The brackets 90 are positioned on the tube 112 such that the openings 92 are positioned and oriented at about 180 degrees from the locking assembly 118. In the illustrated embodiment, three brackets 90 are attached to the tube 112. Alternatively, any desired number of brackets 90 may be attached to the tube 112. A first end 90A of a first of the brackets 90 is positioned about 1.92 inches from the first end 114 of the tube 112. The first ends 90A of a second and a third of the brackets 90 are positioned about 15.42 inches and 32.92 inches, respectively, from the first end 114. Alternatively, the brackets 90 may be positioned at any desired distance from the first end 114.

The locking assembly 118 is attached to the tube 112 such that the center 121 of the member 120 is positioned about 1.25 inches from the first end 114 of the tube 112. Alternatively, the locking assembly 118 may be attached at any desired distance from the first end 114 of the tube 112, such as within the range of from about 0.90 inches to about 6.0 inches from the first end 114 of the tube 112.

Figure 13:
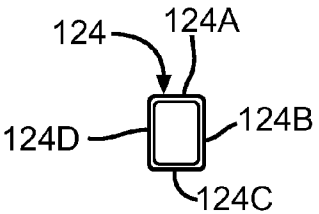
FIG. 13 is an end view of the end wall rail coupler illustrated in FIG. 2.

Referring now to FIG. 13, there is illustrated generally at 124 an end wall rail coupler for interconnecting the left and right end wall side rails 110 and 122. The coupler 124 is formed as a substantially hollow tube having a substantially rectangular transverse section. The tube 124 includes sides 124A, 124B, 124C, and 124D. The sides 124A and 124C have an outside width of about 2.5 inches. The sides 124B and 124D have an outside width of about 3.5 inches. Alternatively, the sides 124A and 124C may have any desired width, such as within the range of from about 1.0 inches to about 5.5 inches, and the sides 124B and 124D may have any desired width, such as within the range of from about 1.0 inches to about 6.5 inches. The tube 124 is structured and configured to be smaller than the left and right end wall side rails 110 and 122, such that the tube 124 may be installed within the left and right end wall side rails 110 and 122 in a telescoping arrangement.

The illustrated tube 124 has a length of about 91.6 inches. Alternatively, the tube 124 may have any desired length, such as within the range of from about 24.0 inches to about 108.0 inches. Alternatively, the tube 124 may have any desired transverse sectional shape, such as square or cylindrical.

Alternatively, the tube 124 may have any desired transverse sectional shape corresponding to the sectional shape of the left and right end wall side rails 110 and 122, such as rectangular or cylindrical.

Figure 14B:
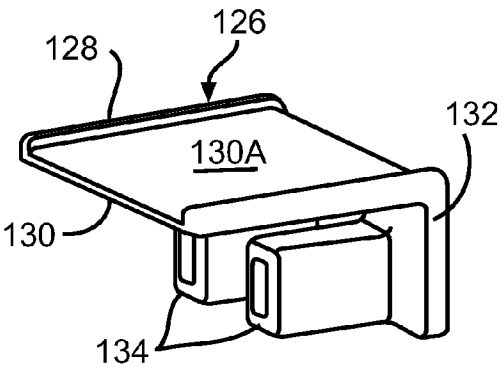
FIG. 14B is a perspective view of the edge protector illustrated in FIGS. 2 and 14A.

Referring now to FIG. 14, there is illustrated generally at 126 an edge protector, the purpose for which is explained in detail below. The edge protector 126 includes a body 128 having a substantially L-shaped transverse section. A first leg 130 defines a horizontal strap surface 130A and a second leg 132 defines a vertical strap surface 132A. A spacer 134 extends inwardly (away from the vertical strap surface 132A. The illustrated spacer 134 has a substantially rectangular transverse section. In the illustrated embodiment, two spacers 134 are shown. Alternatively, any desired number of spacers 134 may be provided.

Figure 15:
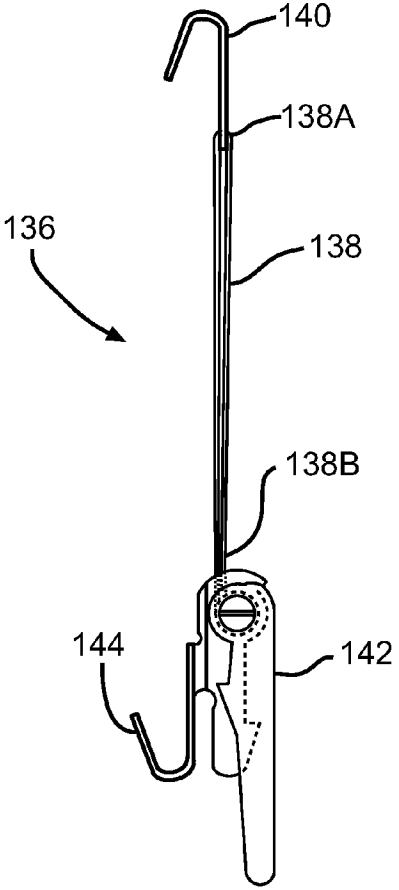
FIG. 15 is a side elevational view of the ratchet strap assembly illustrated in FIG. 2.

Referring now to FIG. 15, there is illustrated generally at 136 a ratchet strap assembly, the purpose for which is explained in detail below. The ratchet strap assembly 136 includes a strap 138. A first flat hook 140 is attached to a first end 138A of the strap 138. The second end 138B of the strap 138 is attached to a ratchet 142. A second flat hook 144 is attached to the ratchet 142. The second flat hook 144 may be attached to the ratchet 142 by any desired method, such as by welding. In the illustrated embodiment, the strap 138 is about 14.0 inches long. Alternatively, the strap may have any desired length, such as within the range of from about 4.0 inches to about 140.0 inches.

The illustrated strap 138 is two inch wide nylon strap or webbing. Alternatively, any desired strap may be used. Additionally, any ratchet strap assembly having a strength of assembly of at least 1,500 lbs. and a working load limit of at least 500 lbs. may be used.

It will be understood that the dimensions of the rails described above may be other than as shown and described and may be adjusted to fit the specific dimensions of the container to which the rails may be attached.

The various combinations of components described above, including rails, tubes, flat brackets, panel brackets, and locking assemblies may be formed from steel. Alternatively, the components may be formed from any other desired material, such as stainless steel, aluminum, titanium plastics, and other metal, non-metal, and composite materials.

It will be understood that the rails 70, 94, 96, 110, 122, and 124 may be attached to the frame 10 by any desired means, such as by welding or with fasteners, such as threaded fasteners (not shown). Alternatively, the brackets 90 may be attached directly to the frame by any desired means, such as by welding or with fasteners, such as threaded fasteners (not shown).

Alternatively, the rails 70, 94, and 96 may be attached to the upper side member 16. Additionally, the rails 70, 94, and 96 may be attached to both the upper side member 16 and the lower side member 14, such that the panels 34 may be attached between the rails 70, 94, and 96 of the upper side member 16 and the rails 70, 94, and 96 of the lower side member 14.

Similarly, the rails 110, 122, and 124 may be attached to the upper end member 20. Additionally, the rails 110, 122, and 124 may be attached to both the upper end member 206 and the lower cross member 18, such that the panels 34, 44 may be attached between the rails 110, 122, and 124 of the upper end member 20 and the rails 110, 122, and 124 of the lower cross member 18.

Figure 16:
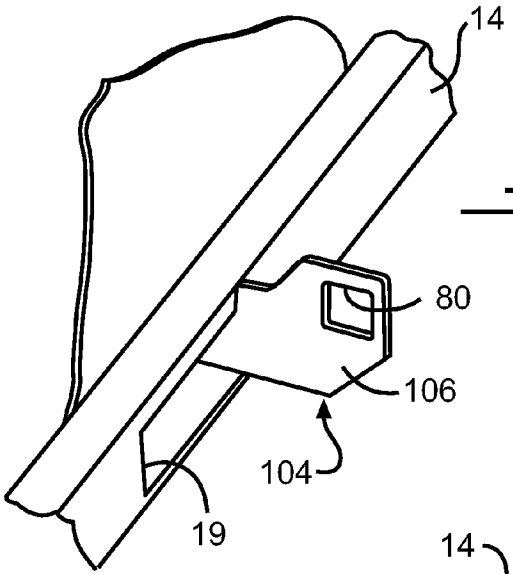
FIG. 16 is a perspective view of a portion of the container and blast and ballistic protection system illustrated in FIG. 2, showing the connector assembly in an installed position.

Installation and attachment of the blast and ballistic protection system 30 to the frame 10 will now be described in reference to FIGS. 16 through 20. As best shown in FIG. 16, a connector assembly 104 is extended through each of the fork lift openings 19 in one lower side member 14 through a corresponding fork lift opening 19 in the opposite lower side member 14. The connector assembly may be positioned such that brackets 106 are substantially perpendicular to a plane of a side wall 33 of the container 32 and such that the mounting apertures 80 are exposed or outboard of the side members 14.

Figure 17:
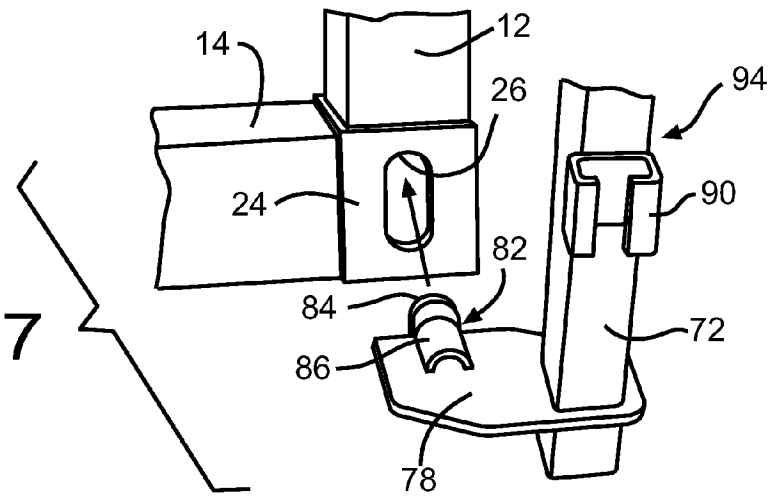
FIG. 17 is a perspective view of a portion the container and blast and ballistic protection system illustrated in FIG. 2, showing the right side wall rail prior to installation.

Referring now to FIG. 17, the right side wall rail 94 is positioned vertically, such that the locking assembly 82 is adjacent the opening 26 in the corner casting 24. The oval shaped locking member 84 of the locking assembly 82 may then be inserted into the oval shaped opening 26.

Figure 18:
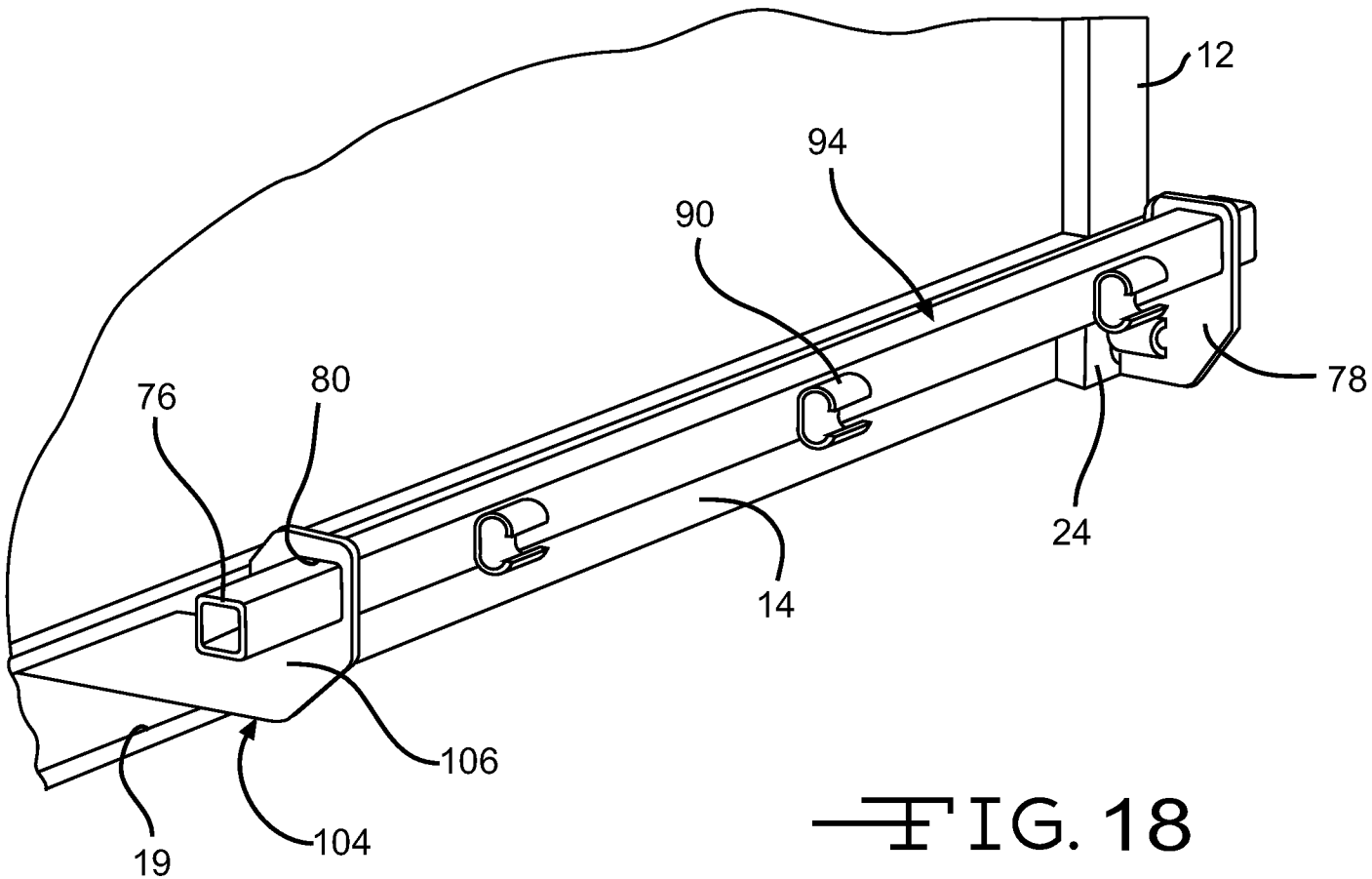
FIG. 18 is a perspective view of a portion the container and blast and ballistic protection system illustrated in FIG. 2, showing the right side wall rail and connector assembly in an installed position.

As best shown in FIG. 18, the right side rail 94 may then be rotated counterclockwise until the rail 94 is in a substantially horizontal position. The second end 76 may then be inserted into the aperture 80 of one of the connector assemblies 104.

The left side wall rail 70 is may be installed in the opposite corner casting 24 in a manner similar to the rail 94, and rotated clockwise until the rail 70 is in a substantially horizontal position. The second end 76 may then be inserted into the aperture 80 of the other of the connector assemblies 104.

Referring again to FIG. 2, the first end 100 of the center side wall rail 96 may then be installed over the second end 76 of the left side wall rail 70 and the second end 102 may be installed over the second end 76 of the right side wall rail 94. A locking member 150 may be inserted through apertures 95 and 97 formed in the overlapping portions of the rails 94 and 96, respectively, to prevent the center side wall rail 96 from moving relative to the rail 94. In the illustrated embodiment, the locking member 150 is a pin. The pin 150 may have a detent at a distal end. Alternatively, the locking member 150 may be any other suitable member, such as a bolt.

Figure 19:
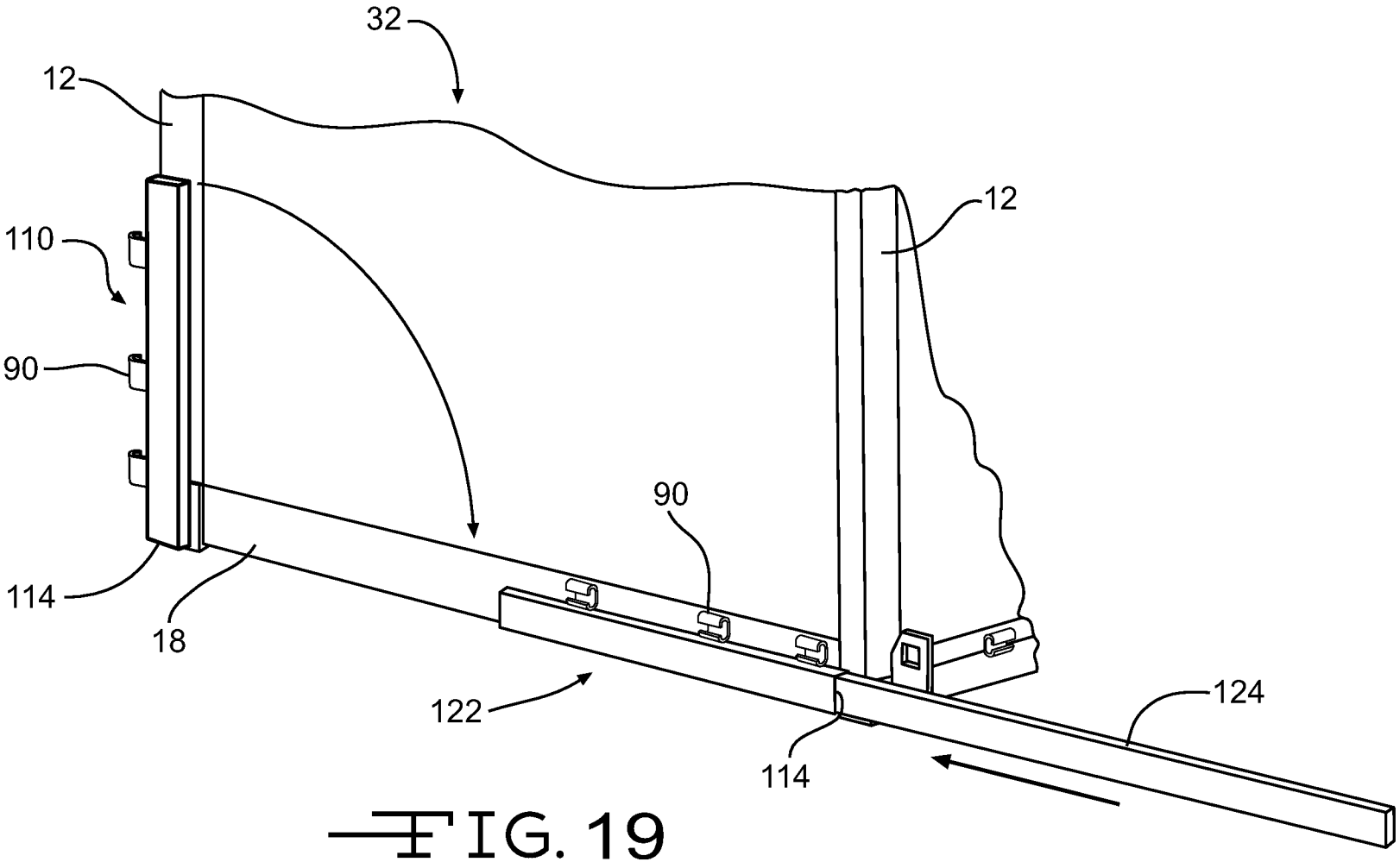
FIG. 19 is a perspective view of the container and blast and ballistic protection system illustrated in FIG. 2, showing the right and left end wall rails, and the end wall rail coupler during installation.

Referring now to FIG. 19, the right end wall rail 122 is also positioned vertically, such that the locking assembly 118 is adjacent the opening 26 in the corner casting 24. The oval shaped locking member locking member 84 of the locking assembly 118 may then be inserted into the oval shaped opening 26. The right end rail 122 may then be rotated counterclockwise until the rail 122 is in a substantially horizontal position. As shown in FIG. 19, the left end rail 110 may be installed in the opposite corner casting 24 in a manner similar to the rail 122, and rotated clockwise until the rail 120 is in a substantially horizontal position.

Figure 2A:
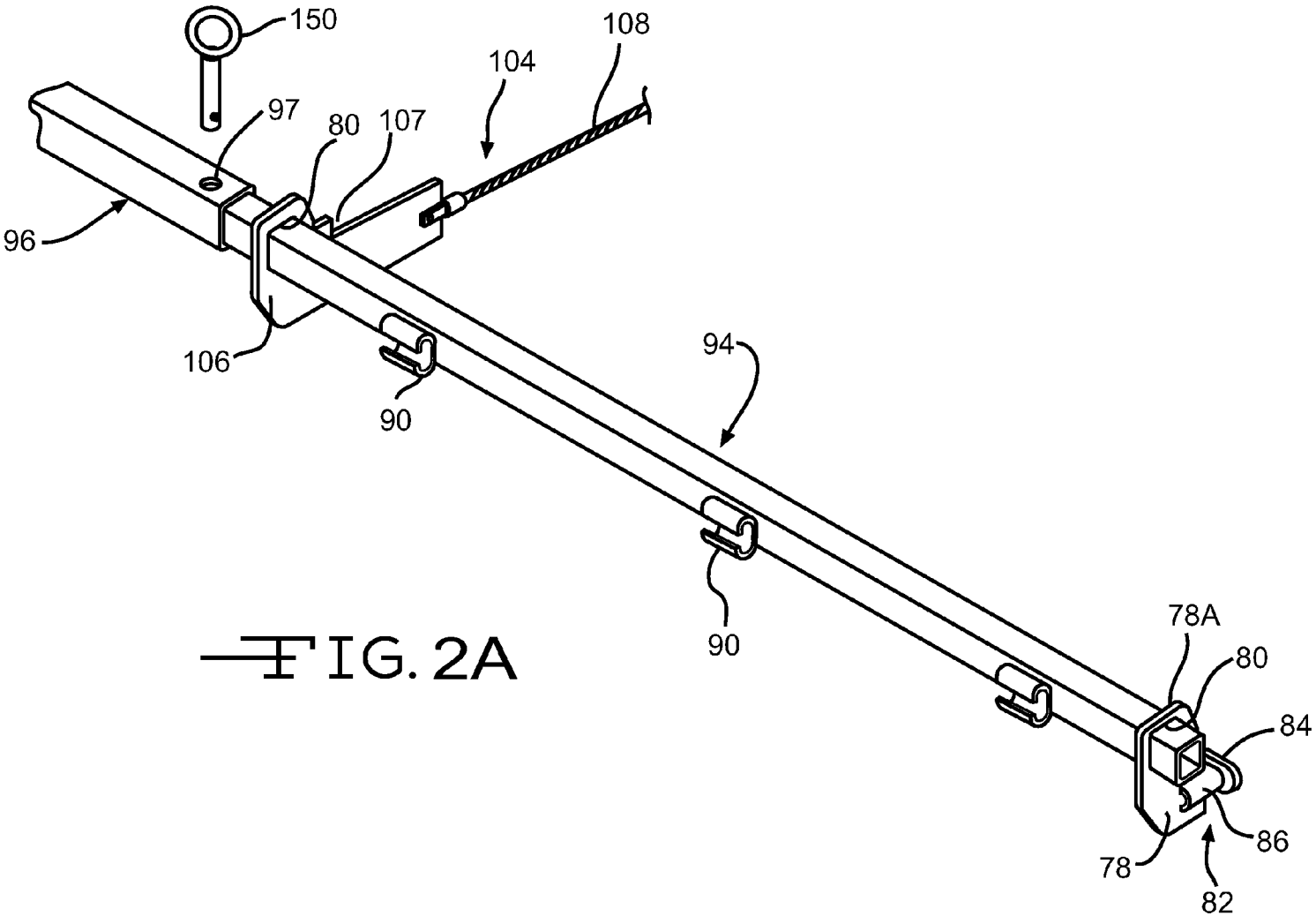
FIG. 2A is an enlarged perspective view of a portion of the blast and ballistic protection system illustrated in FIG. 2.

The end wall rail coupler 124 may then be inserted into the rails 110 and 122 until the distal ends of the coupler 124 are substantially flush with the respective first ends 114 of the rails 110 and 122. A locking member, such as the pin 150 illustrated in FIG. 2A, may be inserted through apertures formed in any of the overlapping portion of the rail 110 and the coupler 124, and any of the overlapping portion of the rail 122 and the coupler 124, to prevent the coupler 124 from moving relative to the rails 110 and 122. The pin 150 may have a detent at a distal end. Alternatively, the locking member 150 may be any other suitable member, such as a bolt.

Figure 14A:
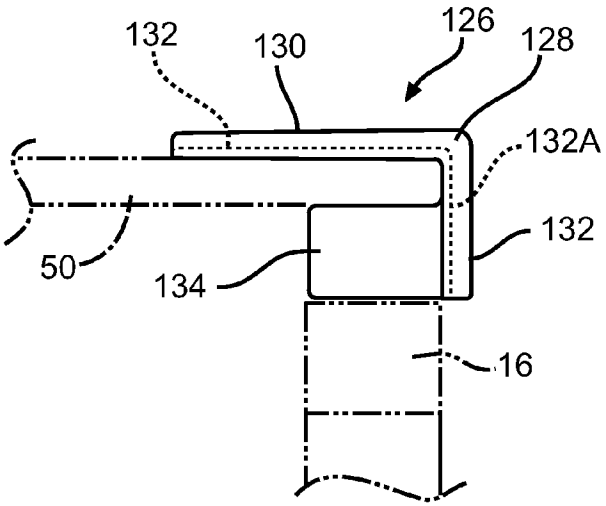
FIG. 14A is a side elevational view of the edge protector illustrated in FIG. 2.

Referring again to FIG. 2, roof end panels 50 may be placed on the roof of the container 32 such that the notches 56 fit tightly against the upper corner castings 25. Edge protectors 126 may be placed at each attachment slot 42 such that spacers are disposed between the panel 50 and the container 32 and the horizontal surface 130A is oriented upwardly, as shown in FIG. 14A.

Roof center panels 58 may then be placed between the roof end panels 50 on the roof of the container 32. Edge protectors 126 may also be placed at each attachment slot 42 in the manner described above.

Figure 20:
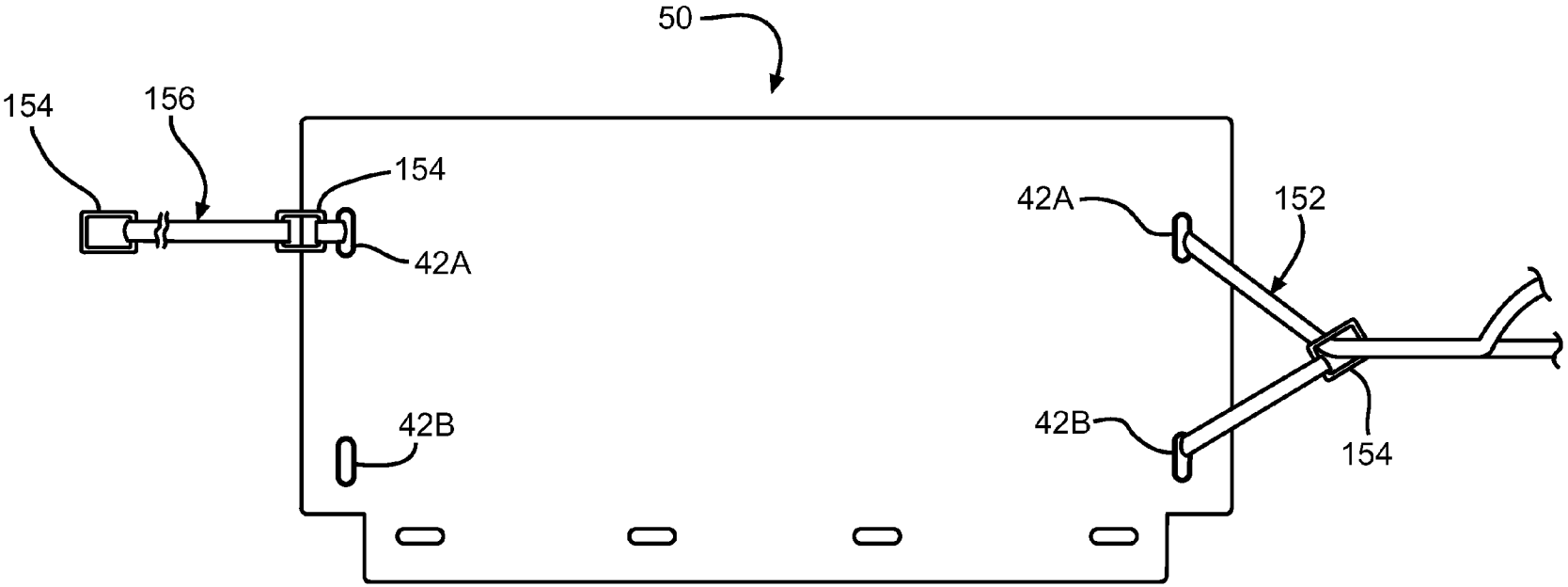
FIG. 20 is a plan view of the roof end panel illustrated in FIGS. 2 and 5, showing the lifting strap and the retention strap installed.

To assist persons installing the panels 50 and 58 on the roof, straps, such as two inch wide nylon webbing, may be secured to the panels 50 and 58. As shown in FIG. 20, a first or lifting strap 152 may be secured, such as with a carabiner 154, through the slots 42A and 42B at one end of the panel. A second or retention strap 156 may be secured through one or both of the slots 42A and 42B at the opposite end of the panel. In the illustrated embodiment, the first strap 152 is attached to the first end 52 of the panel 50, and the second strap 156 is attached to the second end 54 of the panel 50. It will be understood that the arrangement of the straps 152 and 156 may be reversed and that the straps 152 and 156 may be attached to the panels 58 in the manner illustrated in FIG. 20.

Prior to placing the roof panels 50 and 58 on the roof of the container 32, the first strap 152 may be thrown over the roof. A person or persons on the side of the container 32 opposite the side from which the panels 50 and 58 will be lifted onto the roof may then pull and hold tension on the strap 152 while the panels 50 and 58 are being lifted onto the roof. The second strap 156 be secured to the side rails 70, 94, and 96 and may have a length, such as about 112.0 inches, that allows the panels 50 and 58 to be placed on the roof but prevents the panels 50 and 58 from being pulled over the roof of the container 32.

Referring again to FIG. 2, the side wall panels 34 may be installed on the sides of the container 32. The panels identified as 34A, 34C, and 34E in FIG. 2 will be installed before the panels identified as 34B and 34D. To install the panels 34, a panel, such as the panel 34A is placed in a substantially horizontal position and the lower end 38 is placed into the openings 92 of the brackets 90 such that the slots 42 are aligned with the brackets 90. The panel 34A may then be easily pivoted or rotated upwardly so that the upper end 40 rests against the side of the container 32. An upper portion of each bracket 90 thus extends through a slot 42. This process may be repeated for the panels 34C and 34E. Advantageously, installing the panels 34 in the manner described above, requires less effort by an installer due to the fact that the panels 34 are rotated into place instead of being lifted into place. Another advantage of the bracket 90 is that the lower end 38 of the panel 34 is locked in place once the panel 34 is rotated upwardly to a substantially vertical position.

Panels 34A, 34E, and 34C are installed at the ends and center, respectively, of the side wall 33 section first, followed by intermediate panels 34B and 34D. This installation order allows for a more equally distributed load on the container 32 and allows for the panels 34 to overlap thereby increasing ballistic protection at panel edges.

The first flat hook 140 of the ratchet strap assembly 136 may then be attached to the slots 42 in each of the roof panels 50 and 58 adjacent the side wall panels 34A, 34C, and 34E. The second flat hook 144 may then be attached to the slots 42 in the upper end 40 of the panels 34A, 34C, and 34E. At this point in the assembly process, the ratchet may be tightened only enough to lift lower end 38 of the panels 34A, 34C, and 34E such that an edge of the lower end 38 is spaced apart from a lower portion of the bracket 90.

The panels 34B and 34D may then be installed in the same manner as the panels 34A, 34C, and 34E described above. When installed the panels 34B and 34D will overlap the panels 34A, 34C, and 34E.

The process of installing the panels 34A-34E may be repeated for the opposite side wall of the container 32.

End wall panels 44 may be installed on the outboard sides of the end wall of the container 32. A first of the two panels 44 is placed in a substantially horizontal position and the lower end 46 is placed into the openings 92 of the brackets 90 such that the slots 42 are aligned with the brackets 90. The panel 44 is then pivoted upwardly so that the upper end 48 rests against the end of the container 32. An upper portion of each bracket 90 thus extends through a slot 42.

The first flat hook 140 of the ratchet strap assembly 136 may then be attached to the slots 42 at the side 50A each of the roof panel 50 adjacent the upper end 48 of the panel 44. The second flat hook 144 may then be attached to the slots 42 in the upper end 48 of the panel 44. At this point in the assembly process, the ratchet may be tightened only enough to lift the lower end 46 of the panel 44 upwardly such that an edge of the lower end 46 is spaced apart from a lower portion of the bracket 90. The second flat hook 144 locates the ratchet strap assembly 136 to ensure the body of the ratchet 142 will remain below an upper edge of the side and end walls of the container 32, ensuring that a desired amount of tension can be attained.

This process may be repeated for a second of the two panels 44. A side wall panel 34 may then be installed in the same manner as the panels 44 described above. When installed, the panel 34 will overlap the panels 44.

Once the panels 34, 44, 50, and 58 have been installed and the ratchet strap assemblies 136 connected as described above, the ratchets 142 may be fully tightened. In one embodiment of a method of tightening the ratchets 142, pairs of opposing ratchets 142, such as the ratchets 142 connected to the straps R1 and R2 in FIG. 2, will be tightened simultaneously by persons on opposite sides of the container 32. The pairs of ratchets 142 will be tightened sequentially from one end of the container 32 to the other end of the container 32.

The ratchet strap assemblies 136 provide tension between the two panels. Such tension allows the straps 138 to absorb and transfer blast energy throughout the ISO container 32 and the attached panels 34, 44, 50, and 58.

The attachment ratchet strap assemblies 136 is the final step in the installation of the blast and ballistic protection system 30. The container 32 may then be used with minimal maintenance while having blast and ballistic protection. It will be understood that the attachment straps may be structured and configured other than as illustrated. For example, straps, such at the straps 138, may be attached to the panels 34 by means other than the ratchet strap assembly 136 illustrated, such as by any means that provide the desired tension to the straps and allows the straps to absorb and transfer blast energy throughout the ISO container 32 and the panels 34, 44, 50, and 58.

It will be understood that any electrical and HVAC connectors disconnected from the container and set aside prior to installing the blast and ballistic protection system 30 may be re-connected after installation of the blast and ballistic protection system 30.

Although the embodiment of the blast and ballistic protection system 30 described and illustrated above include panels 34, 44, 50, and 58 installed on two sides, the closed end, and the roof of a container 32, other configurations of the blast and ballistic protection system 30 are contemplated. For example, the environment in which the container 32 is used may require that panels 34, 44, 50, and 58 be installed on any one side, the closed end, the roof, or any combination of the sides, closed end, and the roof.

In an embodiment of the blast and ballistic protection system wherein the roof panels 50 and 58 are not used, the ratchet strap assembly 136 may be attached between the slots 42 on the upper end 40 of a panel 34 on one side of the container 32 and the slots 42 on the upper end 40 of a panel 34 on the other side of the container 32. If only one side of the container will have panels 34 attached, the ratchet strap assembly 136 may be attached between the slots 42 on the upper end 40 of the panels 34 and rails 70, 94, and 96 attached between the corner castings 25 on the other side of the container 32, or directly to the upper side member 16.

Similarly, in an embodiment of the blast and ballistic protection system wherein the roof panels 50 and 58 are not used, but panels 34 are installed on both sides of the container, the ratchet strap assembly 136 may be attached between the slots 42 on the upper end 40 of a panel 34, 44 on an end wall of the container 32 and the straps 138 interconnecting the panels 34. If such a strap 138 is not available, a roof end panel 50 may be installed between panels 34 installed on both sides of the container adjacent the end wall of the container. The ratchet strap assembly 136 may then be attached between the slots 42 at the side 50A of the panel 50 and the slots 42 on the upper end 40 of the panels 34 and the upper end 48 of the panel 44. Alternatively, a modified version of the panel, illustrated by phantom line 50' in FIG. 5, may be installed on the roof. Such a roof end panel may be substantially identical to the panel 50 but may be narrower, i.e., having a width W4 only wide enough to accommodate the slots 42 required to provide attachment points for the ratchet strap assemblies 136 also connected to the panels 34 and 44.

In an alternative embodiment of the blast and ballistic protection system wherein the roof panels 50 and 58 are not used, panels similar to the panels 34 and 44, but having a length longer than the height of the container 32 such that the slots 42 extend beyond or above an upper edge of the container when the panels 34 and 44 are installed on the container 32. Such panels are illustrated by phantom lines 34' and 44' in FIGS. 3 and 4, respectively. In such an embodiment, the straps 138 of the ratchet assembly 136 may be inserted or woven through the openings in the upper corner castings 25, and connected to the corner casting 25.

The illustrated side wall rails 70, 94, and 96 provide an offset from the container wall at the lower end 38 of the panel 34. This offset allows the panels 34 to flex and absorb blast energy with minimal transfer to the container 32. The blast and ballistic panels 34 also provide a shield for the container from the majority of the blast pressure. The blast pressure, depending on magnitude, may buckle and permanently deform the container 32, degrading its structural stability.

The end wall rails 110, 122, and 124 may not require the same offset from the container 32 as the side wall rails 70, 94, and 96, because the structural design of the typical end wall section of an ISO container 32 is stronger and more able to handle UFC blast loading.

It will be further understood that the blast and ballistic protection system 30 may be easily disassembled in substantially the reverse order that the system 30 was assembled. The disassembled blast and ballistic protection system 30 may be compactly arranged and stored in a suitable container, such as a shipping crate structured and configured to receive the components of the blast and ballistic protection system 30 in a minimum amount of space.

The embodiments of the blast and ballistic protection system 30 described and illustrated above provide significant additional advantages to the user. For example, the design and method of attachment of the blast and ballistic protection system 30 allows a protected container to be moved and stacked like a typical ISO container with typical ISO container handling equipment without removal of the components of the blast and ballistic protection system 30. The forklift openings 19 remain clear after the installation of the blast and ballistic protection system 30, allowing unobstructed access for movement. Additionally, the upper corner castings 25 of the container 32 remain unobstructed to allow movement of the containers by crane.

Further, the blast and ballistic protection system 30 creates a standoff between the ballistic panels and the ISO container walls to allow the ballistic panels to shield the container walls from blast pressures. The standoff also allows the attached ballistic panels to flex and absorb a portion of the blast energy before the panels contact the container walls. The unique pivoting panel attachment system; i.e., the locking assembly 82, allows any vertically placed panels to be easily installed in the proper position with minimal lifting effort. Once a panel is pivoted into position, the base of the panel is locked onto the bottom rail via the bracket 90 with no further fastening required. The illustrated embodiments also include an embodiment of a ratchet strap assembly 136. The ratchet strap assembly 136 allows the panels to be quickly connected together in a method that is strong enough to support blast pressures. The corner castings 24 and 25 at the lower and upper corners, respectively, of the ISO container 32 are typically the strongest portion of the container 32. The illustrated rails 70, 94, 96, 110, 122, and 124 are structured and configured to be attached to the corner castings 24, 25 at either the lower or upper corners of the container 32.

Advantageously, it has been shown that the embodiments of the blast and ballistic protection system 30 described and illustrated above, successfully withstood blasts as specified by the Unified Facilities Criteria, Department of Defense Minimum Antiterrorism Standards For Buildings, and ballistic testing including specific right circular cylinder projectiles (RCC), live fire testing, and testing in accordance with National Institute of Justice level NIJ IIIA.

The principle and mode of operation of the blast and ballistic protection system have been described in its preferred embodiment. However, it should be noted that the blast and ballistic protection system described herein may be practiced otherwise than as specifically illustrated and described without departing from its scope.

What is claimed is:

1. A blast and ballistic protective wall assembly (30) for use on an exterior of a container (32) having a frame (10), the frame including four corner posts (12), two lower side members (14) having fork lift openings (19) formed therethrough, two upper side members (16), two lower cross members (18), two upper cross members (20,22), lower corner castings (24) attached to the lower ends of the corner posts (12), and upper corner castings (25) attached to the upper ends of the corner posts (12), the frame supporting side walls (33), end walls, and a roof of the container, the blast and ballistic protective wall assembly (30) comprising:

an attachment member (70, 94, 110, 122, 90) attached to a portion of the Frame (10);

a plurality of composite panels (34, 44); and a connection member, the connection member interconnecting each panel to the one of another panel, a portion of the frame, and another attachment member;

wherein one end of each panel (34, 44) is attached to the attachment member (70, 94, 110, 122, 90), and the other end of the panel (34, 44) is attached to one of another panel (34, 44), a portion of the frame (10), and another attachment member (70, 94, 110, 122, 90), each panel being thereby attached to a wall of the container (32); and wherein each panel attached to a wall of the container one of overlaps and underlaps an adjacent panel.

2. The blast and ballistic protective wall assembly according to claim 1, wherein the attachment member is a panel bracket structured and configured to interconnect a panel to the frame.

3. The blast and ballistic protective wall assembly according to claim 2, wherein the attachment member is a panel bracket inserted into a slot formed in the panel.

4. The blast and ballistic protective wall assembly according to claim 1, wherein the attachment member is a rail attached to one of the lower corner castings and the upper corner castings of the frame on a side of the container.

5. The blast and ballistic protective wall assembly according to claim 4, further including panel brackets attached to the rail and structured and configured to interconnect a panel to the rail.

6. The blast and ballistic protective wall assembly according to claim 4, further including a locking assembly attached to the rail and structured and configured for insertion into an opening formed in one of the lower corner castings and the upper corner castings of the frame.

7. The blast and ballistic protective wall assembly according to claim 1, wherein the attachment member is an end rail attached to one of the lower corner castings and the upper corner castings of the frame on an end wall of the container.

8. A blast and ballistic protective wall assembly for use on an exterior of a container having a frame, the frame including four corner posts, two lower side members having fork lift openings formed therethrough, two upper side members, two lower cross members, two upper cross members, lower corner castings attached to the lower ends of the corner posts, and upper corner castings attached to the upper ends of the corner posts, the frame supporting side walls, end walls, and a roof of the container, the blast and ballistic protective wall assembly comprising:

a plurality of attachment brackets attached to a portion of the frame;

a plurality of composite panels; and a connection member, the connection member interconnecting each panel to the one of another panel, a portion of the frame, and another attachment bracket;

wherein one end of each panel is attached to at least one attachment bracket, and the other end of the panel is attached to one of another panel, a portion of the frame, and another attachment bracket, each panel being thereby attached to a wall of the container; and wherein each panel attached to a wall of the container one of overlaps and underlaps an adjacent panel.

9. The blast and ballistic protective wall assembly according to claim 8, wherein the attachment brackets have a substantially C-shaped transverse section.

10. The blast and ballistic protective wall assembly according to claim 8, wherein the attachment bracket is inserted into a slot formed in a panel.

11. The blast and ballistic protective wall assembly according to claim 8, further including a rail attached to one of the lower corner castings and the upper corner castings of the frame on a side of the container.

12. The blast and ballistic protective wall assembly according to claim 11, wherein the attachment brackets are attached to the rail and structured and configured to interconnect a panel to the rail.

13. The blast and ballistic protective wall assembly according to claim 11, further including a locking assembly attached to the rail and structured and configured for insertion into an opening formed in one of the lower corner castings and the upper corner castings of the frame.

14. A blast and ballistic protective wall assembly for use on an exterior of a container having a frame, the frame including four corner posts, two lower side members having fork lift openings formed therethrough, two upper side members, two lower cross members, two upper cross members, lower corner castings attached to the lower ends of the corner posts, and upper corner castings attached to the upper ends of the corner posts, the frame supporting side walls, end walls, and a roof of the container, the blast and ballistic protective wall assembly comprising:

a first rail rotatably and removably attached to one of a lower side member and an upper side member of the frame;

a plurality of attachment brackets extending outwardly of the first rail;

a plurality of composite panels having an attachment slot formed therethrough, wherein one of the attachment brackets extends through a slot at the first end of each panel; and a connection member attached within a slot at a second end of each panel, the connection member interconnecting each panel to one of another panel, a portion of the frame, and the other of the lower side member and the upper side member.

15. The blast and ballistic protective wall assembly according to claim 14, further including:

a second rail rotatably and removably attached to one of a lower cross member and an upper cross member of the frame;

a plurality of attachment brackets extending outwardly of the second rail;

a plurality of composite panels having an attachment slot formed therethrough, wherein one of the attachment brackets extends through a slot at the first end of each panel; and a connection member attached within a slot at a second end of each panel, the connection member interconnecting each panel to one of another panel, a portion of the frame, and the other of the lower cross member and the upper cross member.

16. The blast and ballistic protective wall assembly according to claim 15, further including:

a plurality of composite panels disposed on the roof of the container;

wherein the connection member is attached within a slot at a second end of each panel, the connection member interconnecting each panel to one of another panel, a portion of the frame, and the other of the lower cross member and the upper cross member.

* * * * *